United States Patent [19]

Sharma

[11] Patent Number: 4,556,213

[45] Date of Patent: Dec. 3, 1985

[54] REVERSIBLE PLAYING OR PERFORMANCE AREA

[76] Inventor: Devendra N. Sharma, 22 Carroll House Barrie Estate, Gloucester Terrace, London, Great Britain, W2 3PR

[21] Appl. No.: 530,704

[22] Filed: Sep. 9, 1983

Related U.S. Application Data

[63] Continuation-in-part of Ser. No. 477,840, Mar. 28, 1983, which is a continuation of Ser. No. 188,129, Sep. 17, 1980, abandoned.

[30] Foreign Application Priority Data

Sep. 17, 1979 [GB] United Kingdom ..... 7932145
May 20, 1983 [GB] United Kingdom ..... 8314103

[51] Int. Cl.[4] ..... A63B 71/02; A63C 19/00

[52] U.S. Cl. ..... 272/3; 52/64; 52/177; 108/13; 272/56.5 SS; 273/176 J; 273/284; 273/287; 404/34; 404/44; 404/71; 428/22; 428/27

[58] Field of Search ..... 273/3 B, 284, 287, 176 J, 273/195 A, 195 R, 195 B, 1 B; 272/3, 1 R, 56.5 SS; 52/177, 64; 404/34–36, 40, 44, 71; 428/17, 22, 27; 108/13

[56] References Cited

U.S. PATENT DOCUMENTS

| | | | |
|---|---|---|---|
| 3,139,283 | 6/1964 | Lester | 273/195 A |
| 3,141,392 | 7/1964 | Schneider et al. | 404/35 X |
| 3,143,350 | 8/1964 | Lester | 273/195 A |
| 3,157,557 | 11/1964 | Palmer | 273/176 J |
| 3,529,831 | 9/1970 | Rogers | 273/195 A |
| 3,669,817 | 6/1972 | McDevitt | 108/13 X |
| 4,275,887 | 6/1981 | Tateyama | 273/284 X |
| 4,365,803 | 12/1982 | Barnes et al. | 273/3 B X |

FOREIGN PATENT DOCUMENTS

| | | | |
|---|---|---|---|
| 255352 | 9/1962 | Australia | 273/176 J |

*Primary Examiner*—Paul E. Shapiro
*Attorney, Agent, or Firm*—Holman & Stern

[57] ABSTRACT

A reversible playing and/or performing area having at least one reversible tray which has separately utilizable opposing plane surfaces. The tray has a bottom and shallow sides. The outer surface of the bottom of the tray provides a first playing surface. The space of the tray defined by the inner surfaces of the bottom and the sides of the tray holds a bedding material which provides the base for a second, opposing playing surface. Suitable device is provided for rotatably reversing the playing surfaces. The reversible area may have a plurality of abutting trays which may be of different shapes and dimensions.

17 Claims, 9 Drawing Figures

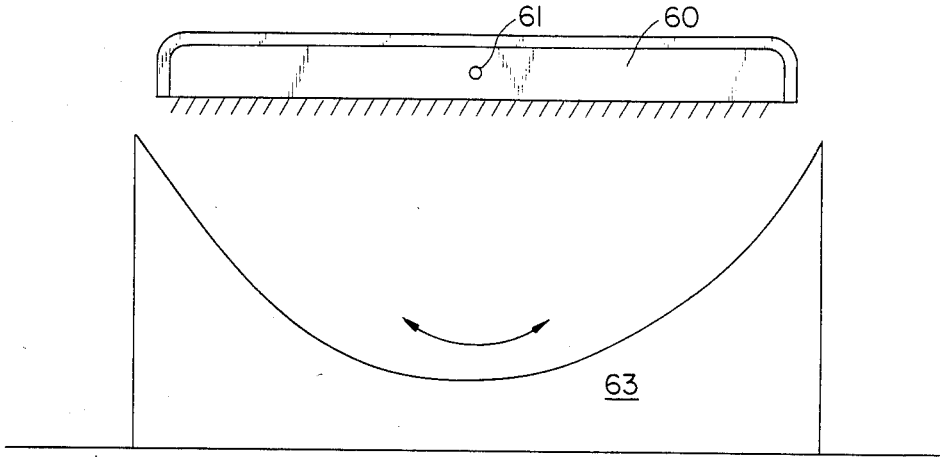
FIG. 6a
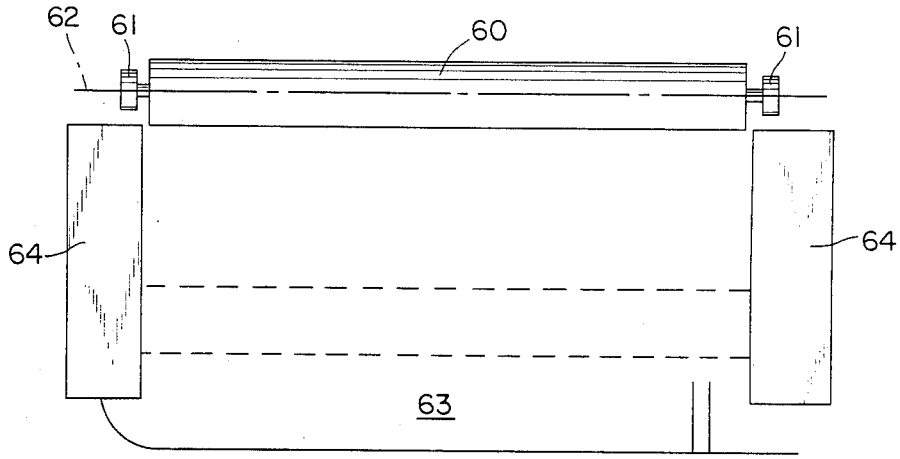
FIG. 6b
FIG. 6c
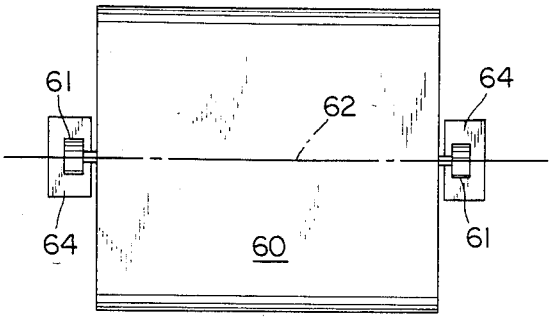

REVERSIBLE PLAYING OR PERFORMANCE AREA

This application is a continuation-in-part of application Ser. No. 6,477,840 filed Mar. 28, 1983 which is a continuation of application Ser. No. 06/188,129 filed Sept. 17, 1980, now abandoned.

BACKGROUND OF THE INVENTION

This invention relates to playing areas for sports, games, performances and the like, that can be converted from one surface to another.

Various artificial surfaces are in use for playing sports and games and giving performances, such as asphalt, clay, wood, composition, artificial grass, and the like. However, laying such surfaces usually dedicates a playing area to only one type of use since changing the surface involves removing or dismantling it or laying another surface over it. This is particularly true when one of the desired surfaces is natural grass such as when a field or meadow is temporarily converted into an artificial surface for playing, performing, dancing, etc.

SUMMARY OF THE INVENTION

This invention affords an apparatus and method of reversibly converting one surface into another. The surfaces may be natural or artificial, slippery or affording good traction, and may be used for playing sports or games, public or private performances, social dancing, and the like.

The area to be converted is composed of at least one and preferably a number of abutting and adjacent area units, each of which is reversible either separately or in conjunction with one or more other units. Each face of the area units affords a different surface. Thus, the units may all have natural grass on one face and a manufactured surface on the other. Where a series of relatively small playing areas are contemplated, such as tennis courts, all the area units may have natural grass on one face and selected unit areas may have different surfaces on the other, such as clay, sand, artificial grass, etc., thus affording a great variety of playing areas suitable for differing playing conditions or preferences. Where sports are contemplated that require different playing area delineations, such as a soccer field and a cricket pitch or such as North American football and baseball, the two surfaces may be composed of the same material but permanently marked differently, or may be composed of different substances such as natural and artificial grass.

It is contemplated that each area unit may either be hinged on the same one side, so that the entire field is slightly displaced when converted, or that each area unit may rotate about a central horizontal axis, so that the area units each remain in the same place. Adjacent area units may be locked together, so that more than one area unit can be reversed at the same time. Motive power for the reversal can be obtained from individual motors for each area unit mounted therein, or from external power sources which can rotate one or more area units simultaneously.

Where one of the surfaces is to be natural grass, the area units may be in the form of trays, the bottoms of which form the artificial surface and the open tops of which afford the grass, retained therein by suitable means. The trays may be fitted with drainage means, heating elements, watering and fertilizing means, and the like, as desired. The trays or area units themselves may be fabricated from any suitable material such as stainless steel, aluminum or magnesium alloys, synthetic resins, glass fibers, composites, or any combination thereof.

BRIEF DESCRIPTION OF THE DRAWINGS

FIGS. 6*a*, 6*b*, and 6*c* are a side view, adjacent side view, and top plan view, respectively, of an embodiment of this invention where the tray is rotated about a central axis.

DETAILED DESCRIPTION OF THE INVENTION

Figure 1:
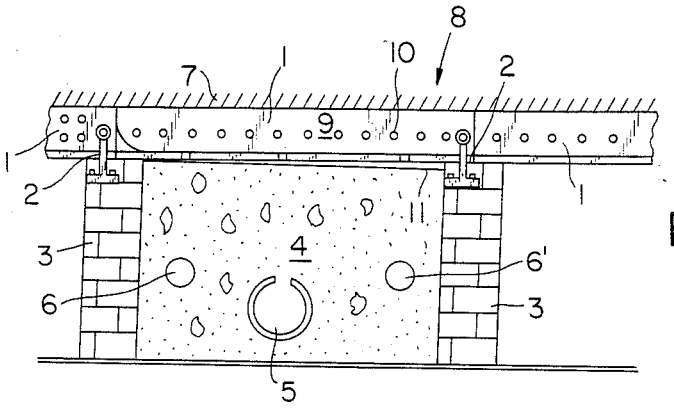
FIG. 1 is a side partial sectional view of the reversible playing surface, its supporting pillers, and the ground, according to this invention.

FIG. 1 is a typical arrangement showing a housing in the form of a tray 1 attached by hinges 2 to support pillers 3. The area between the pillers 3 is filled with dirt, gravel, sand, and/or other suitable fill 4, serving to support both the pillers 3 and the tray 1. Drainage means are preferably provided, such as a main drainage channel 5 and possibly subsidiary drainage channels 7, 7'. The hinges 2 may be of any suitable type such as a double leaf, cup and ball, slip pin, link hinge, and the like, and typically may be permanently mounted in the pillers 3 but detachable or removable from the trays 1, to permit repair and/or servicing of the trays. The trays 1 are preferably rectangular in top plan view to permit reversing as many adjacent area units as is desired. Other polygons or symmetrical interlocking curved areas also may be suitable. The trays 1 may be very shallow where the opposing surface are both synthetic. Preferably, the trays should be deep enough to accommodate natural grass 7 and a suitable rooting material 8 such as a soil or sphagnum. In FIG. 1, the sides 9 of the tray 1 are shown. In this embodiment, the sides 9 have a series of holes 10 through which a fine wire or cord (not shown) may be laced or strung and connected to corresponding holes on the opposite side of the tray, as a means for retaining the natural grass in the tray when it is in upside down position. Other suitable retaining means may also be employed, such as fine-strand, widely-separated, plastic or wire mesh laid across the grass top surface. The pillers 3 may be constructed of any suitable material, such as wood pilings, poured or preformed concrete, brick, or the like. The tray 1 may be constructed of any material, provided that it is strong enough to support itself while being reversed and to support people or objects that would suitably stand upon it, and further provided that it is resistant to corrosion and weathering. A light, strong, non-corrosionable material such as an aluminum or steel alloy or a plastic is preferred. In constructing the hinges 2 and pillers 3, sufficient room must be left above the top surface of the fill 4 so that the natural grass 7 will not be crushed when the area unit is upside down.

Figure 2:
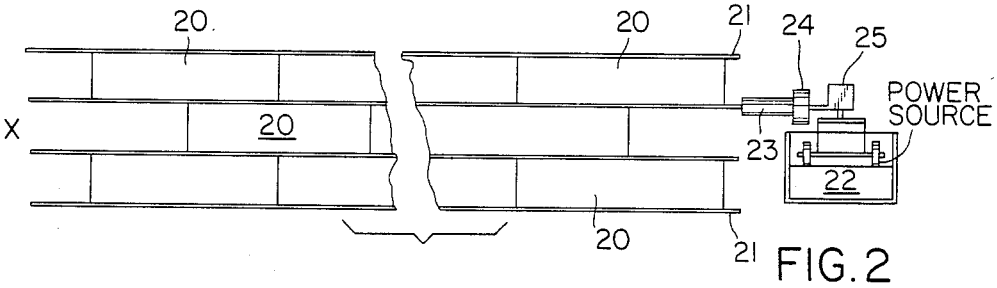
FIG. 2 is a top plan view showing a typical mosaic of area units and a connected power source, according to this invention.

FIG. 2 shows a typical arrangement of placing the area units. The area unit trays 20 may be rectangles arranged in a square or rectangular mosaic grid pattern or may be in a mosaic grid pattern in which alternate rows are offset, as shown in FIG. 2. In the embodiment shown, several of the area unit trays 20 are connected by a main axle 21 so that they may be reversed at the same time. The area units 20 may vary greatly in size, depending upon whether they are to be reversed manually or by power means. Area units to be reversed manually may be as small as 10 $m^2$ or less, but larger power-reversed units may be as large as can be accommodated by the strength of their materials, typically up to 10 m×5 m. Adjacent area units may be fastened together by any removable fastening means, such as stove bolts, wing bolts, slide fasteners, or the like, to permit more than one area unit to be reversed simultaneously. Naturally, such fastened units must move about a common rotational axis. A power source 22 may be connected to a main axle 21 in any conventional manner, such as by a flexible coupling means 23, clutch and reversing unit 24, and high ratio gear unit 25. The power source may be mobile or stationary, permanently or temporarily attached, and may be an internal combustion or diesel engine, an electric motor, or the like. The electric motor may be powered by a solar energy converter. Either a single large power source may be used, with suitable power transmission means, or a mobile power source may be used to reverse area units in succession. It is also possible to have a number of small electric motors, each operatively connected to at least one area unit tray, and operated from a single control, so that all or a number of area units could be reversed simultaneously.

Figure 3:
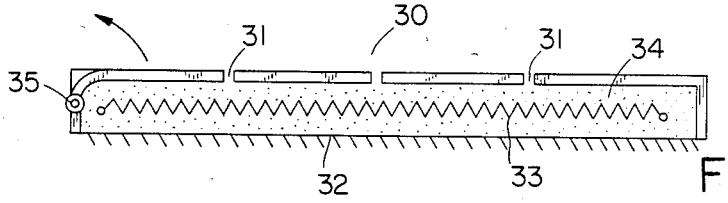
FIG. 3 is a side sectional view of a typical reversible area unit tray in reversed (upside down) position showing heating means and drain means, according to this invention.

FIG. 3 shows an inverted tray 30 having a hinge 35 at one side. Drainage outlets 31 are located in what would be the bottom when the natural or artificial grass 32 is exposed. An electrical resistance wire or strip 33 is buried inside the bedding 34, to melt any snow or frost that might be deposited on either surface during cold weather.

Figure 4:
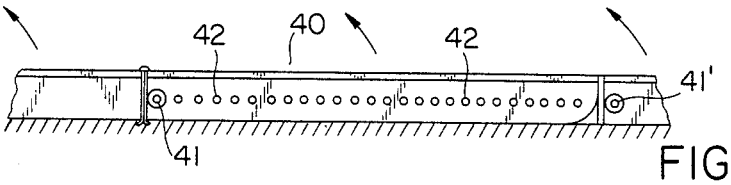
FIG. 4 is a side sectional view of a tray in reversed (upside down) position showing retaining means for natural grass, according to this invention.

FIG. 4 shows a tray 40 with hinges 41, 41'. The arrows indicate the direction of movement when the tray is reversed. Small holes 42 are located on opposing sides for fixing nylon string or stainless steel wire or thin stainless steel rods for retaining the soil or bedding and the natural or artificial grass.

Figure 5:
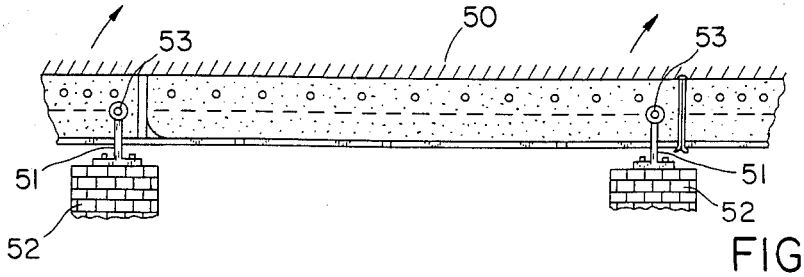
FIG. 5 is a side view of a tray in normal position (natural grass on top), according to this invention.

FIG. 5 is a side view of a tray 50 with the natural or artificial grass exposed, the arrows indicating the movement of the tray when it is reversed. The hinges 51 are fixed to the pillers 52 and are connected to the central axis 53.

FIGS. *6a, 6b* and *6c* show different perspectives of an arrangement wherein the hinge 61 operates around a rotational axis 62 located in the center of the tray 60. In this embodiment the fill 63 must be sufficiently evacuated to permit the tray 60 to rotate about its central axis. Pillers 64 would be located beneath each hinge to give it, and the tray, sufficient support. The hinges 61 in this embodiment would be of a type that permits rotational movement of the required type, such as pivot bearings, swivel bearings, and the like. Means should also be provided for preventing further rotational movement when the desired surface is exposed. Such means may be by locking the tray to the support pillers 64 or to other support means on the sides of the tray which are not hinged. It also is contemplated to afford intertray locking means by which each tray is locked to one or more adjacent trays, effectively preventing further rotational movement.

Figure 7:
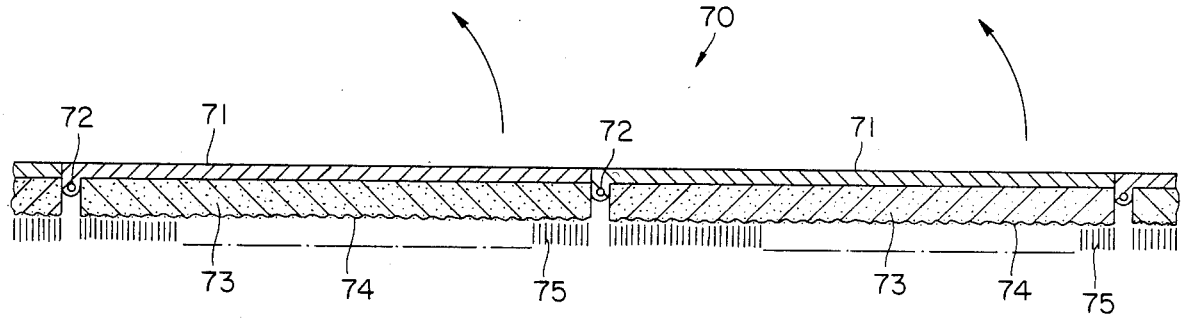
FIG. 7 is a side view of abutting trays according to this invention, which appeared in the predecessor applications.

FIG. 7 shows an embodiment from my prior applications, Ser. Nos. 188,129 and 477,840 in which the artificial surface 71 is slippery steel, for use with bumper cars, and the like. This figure shows a reversible sheet arrangement 70 for provision of a slippery surface or for a surface with natural or artificial grass 75 for playing athletic games such as rugby, soccer or cricket, the bedding or soil 73 being held by wire webbing or netting 74 which may be metal or plastic. The soil may be replaced by asphalt, plastic, or some other suitable material when the grass 75 is artificial. Hinges 72 are provided on one edge of each tray. The arrows show the direction of movement when the trays are reversed. When artificial grass 75 is employed, the bedding 73 may be as thin as desired, always affording sufficient cushion to prevent injury. In this embodiment the trays do not have sides, but such sides may be provided when desired.

I claim:

1. A reversible playing or performance area assembly comprising:

at least one unit tray having first and second opposing plane surfaces;

wherein each unit tray has a bottom and shallow sides, the outer surface of said bottom affording a base for the first of the opposing plane surfaces and wherein a bedding material is located within the space defined by the inner surfaces of the bottom and sides, to afford a base for the second of the opposing plane surfaces and means being provided for rotatably reversing the playing areas of said tray.

2. The reversible area of claim 1 comprising a plurality of abutting trays.

3. The reversible area of claim 2 wherein the trays are all polygons of about the same shape and dimensions.

4. The reversible area of claim 3 wherein the trays are all rectangles arranged in a square or rectangular mosaic grid pattern.

5. The reversible area of claim 3 wherein the trays are all rectangles arranged in a mosaic grid pattern in which alternate rows are offset.

6. The reversible area of claim 3 wherein the first plane surface is covered with a synthetic or natural material to afford a first playing or performing area, and wherein the second plane surface is covered with a natural or synthetic grass to afford a second playing or performing area.

7. The reversible area of claim 6 wherein the bedding and natural or synthetic grass are held within the tray by retaining means attached to the sides of said tray.

8. The reversible area of claim 7 wherein an electrical heating means is provided within said bedding to prevent the accumulation of ice or snow on either of the opposing surfaces.

9. The reversible area of claim 8 wherein drain means are provided in said tray for removing rainwater and melted snow or ice.

10. The reversible area of claim 3 wherein hinge means are located at one side of each said tray, said side forming the axis of rotation when said tray is reversed.

11. The reversible area of claim 3 wherein hinge means are located along a central axis bisecting each said tray, which tray is reversed by rotating it around said axis.

12. The reversible area of claim 3 wherein removable linking means are provided for joining together two or more adjacent trays, so that said trays may be reversed simultaneously.

13. The reversible area of claim 3 wherein powered motive means are provided for reversing each said tray, operatively connected to said tray.

14. The reversible area of claim 13 wherein the powered motive means comprises a disconnectable internal combustion engine, electric motor, or diesel engine.

15. The reversible area of claim 13 wherein the powered motive means is a plurality of electric motors, each of which is fixedly operatively connected to at least one said tray.

16. The reversible area of claim 15 wherein each of said electric motors is connected to a single control unit.

17. The reversible area of claim 15 wherein said electric motors are powered by solar energy converters.

* * * * *